United States Patent [19]

De Barbieri

[11] Patent Number: 4,947,568

[45] Date of Patent: Aug. 14, 1990

[54] WIRE IDENTIFICATION DEVICE

[76] Inventor: Alfredo De Barbieri, 3812 Fort Worth Ave., Alexandria, Va. 22304

[21] Appl. No.: 284,376

[22] Filed: Dec. 14, 1988

[51] Int. Cl.[5] ..... G09F 3/00

[52] U.S. Cl. ..... 40/316

[58] Field of Search ..... 40/316, 628, 660; 174/112, 84 C

[56] References Cited

U.S. PATENT DOCUMENTS

| | | | |
|---|---|---|---|
| 4,019,272 | 4/1977 | Kerz | 40/316 |
| 4,268,986 | 5/1981 | Piana | 40/316 |

FOREIGN PATENT DOCUMENTS

| | | | |
|---|---|---|---|
| 1321537 | 2/1963 | France | 40/316 |
| 480934 | 3/1938 | United Kingdom | 40/660 |
| 1039122 | 8/1966 | United Kingdom | 40/316 |

*Primary Examiner*—Cary E. Stone

*Attorney, Agent, or Firm*—Cushman, Darby & Cushman

[57] ABSTRACT

An identification device for an electrical wire, comprising a cylindrical left portion adapted to be mounted on a wire to be identified, and a cylindrical right portion severably attached to the left portion and adapted to be severed and slid transversely over the left portion to frictionally engage the first portion. The left portion is preferably integrally connected with a wire terminal, such as a ring, pin, or spade terminal and the like. The left portion is crimped along with the terminal to from an electrical connection between the terminal the stripped end of the wire the terminal is to be connected to. An identifying portion is connected to the right portion, and adapted to visibly display alpha-numeric symbols or the like. The identifying portion is preferably an at least partially transparent hollow portion adapted to contain members with indicia printed thereon.

12 Claims, 2 Drawing Sheets

Fig. 4.
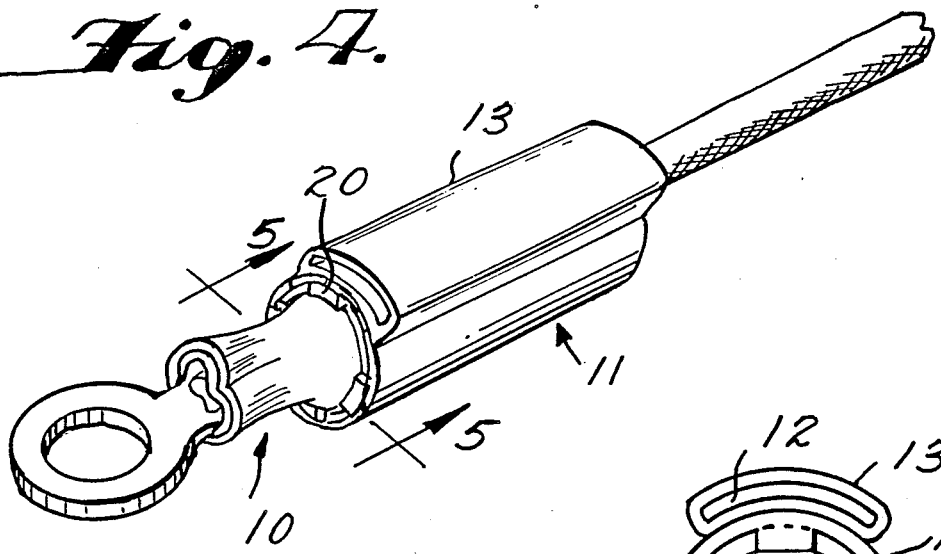
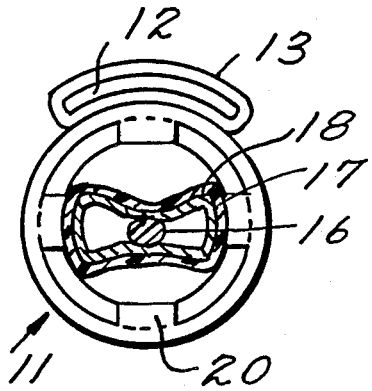
Fig. 5.
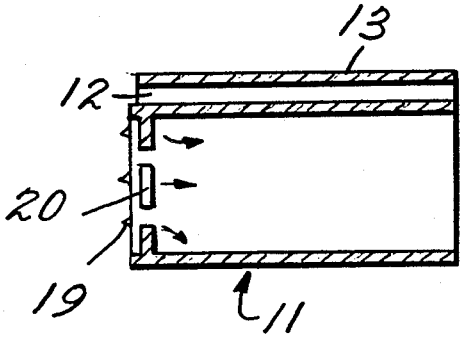
Fig. 6.

WIRE IDENTIFICATION DEVICE

BACKGROUND OF THE INVENTION

The present invention relates to a wire identification device and method for identifying wires. More particularly, the present invention relates to a wire identification device for use with electrical terminals of various types, such as ring, pin, and spade terminals. The identification device of the present invention is adapted to carry identification means carrying alpha-numeric or other indicia, symbols or the like.

A common method of identifying wires, electrical terminals and the like comprises attaching pre-printed strips of marked, adhesive tape on the wire to create the desired marking. Commonly, such pre-printed strips are provided on small cards which can be carried around with the electrician or electrical technician responsible for marking the wires. The disadvantage of such a method of marking wires is that it is difficult and time consuming to wrap a number of pieces of adhesive tape around the wire to be marked one at a time. It is particularly difficult to mark wires in such a fashion when the wires are disposed in a tight space. A further disadvantage of such devices is that the adhesive tape upon which each of the symbols constituting the marking is placed commonly wear out after a period of time. The adhesive may also become loosened due to heat or high humidity.

In response to the difficulties and disadvantages of such a wire marking system, it has been known to provide a wire identification device having a portion to be attached to the wire, such as a sleeve, clip or pressure adhesive strip, and a hollow cylindrical form adapted for containing individual marking elements having alpha-numeric symbols or the like printed thereon. In this system, the first attaching portion is attached to the wire and then the desired marking elements are inserted into the hollow cylindrical form, or alveolus channel, so that the desired marking is visible through the transparent material of the hollow cylindrical form. The desired marking is made by removing the appropriate cylindrical marking elements from a plastic strip to which they are attached. This is done by using a specially designed marking tool and the operation is made from left to right (first marking element first, etc.).

The advantage of such a system is that the marking elements are shielded by the hollow form that houses them, and the marking stays clear and perfectly legible for many years. Another advantage is that the cylindrical marking elements may be removed, but that a special tool is needed to remove them. The marking is normally not disturbed under usual conditions of use.

The above-described identification device is also described in U.S. Pat. No. 4268,986. The identification device of the patent has a body portion which is adapted to be springingly engaged with the object to which the holder is to be connected, such as a wire.

Yet another device is known in which the process of U.S. Pat. No. 4,268,986 is incorporated into a construction for a pin-like terminal for an electrical wire. In this device, an alveolus channel such as that described in the patent is attached to a collar for a conventional pin terminal. Such a device is mounted at the terminus of a wire by stripping an end portion of the wire then inserting the wire into a metal pin cylinder. The pin cylinder is then crimped to hold the stripped portion of the wire to the pin terminal. The collar and the alveolus channel in which the marking members, or initialed rings are inserted extends away from the end of the wire, and away from the pin terminal.

The disadvantage of the above device is that it is inconvenient to use the device with wire terminals other than pin terminals. For example, in the case of spade terminals or terminal rings, the collar of the terminal itself is crimped onto the stripped end of the wire. In order to attach a marking portion such as the alveolus channel of the '986 patent to the collar of a spade terminal or terminal ring, a device must be made quite a bit longer than would normally be desirable.

It is therefore an object of the present invention to provide a marking device for the terminal ends of wires in which one portion of the device may be crimped, and, thereafter, the crimped portion may be easily marked without much effort.

It is also an object of the present invention to provide a marking element for the terminal ends of wires which is easy to use, which will not extend unduly beyond the stripped portion of the wire, and which can be utilized in situations where spacial constraints exist.

It is yet another object of the present invention to provide a wire marking device in which the marking means are rotatable around the long axis of the wire.

SUMMARY OF THE INVENTION

In accordance with the above objects, there has been provided an identification device for an electrical wire, comprising a cylindrical left portion adapted to be mounted on a wire to be identified, and a cylindrical right portion severably attached to the left portion and adapted to be severed and slid transversely over the left portion to frictionally engage the first portion. An identifying portion is connected to the right portion, and comprises an at least partially transparent alveolus channel for containing and visibly displaying identification means.

In a preferred embodiment of the present invention, the right portion comprises engaging means for frictionally engaging the left portion when the right portion is slid over the left portion. These engaging means may be lugs or ridges, or the like. In the preferred embodiment, the right portion has an inner diameter greater than the inner diameter of the left portion to facilitate the right portion sliding over the left portion after crimping. A wire terminal such as a ring, pin, or spade terminal is preferably connected to the left portion of the device.

Further objects, features and advantages of the present invention will become apparent from the description of the preferred embodiment which follows, when considered in conjunction with the figures of drawing.

BRIEF DESCRIPTION OF THE DRAWINGS

FIG. 4 shows the wire identification device after the right portion has been slid over the left portion to frictionally engage the left portion;

FIG. 5 is a cross sectional view of the wire identification device as in FIG. 4; and FIG. 6 is cross section of the right portion of the device taken along the long axis of the device 5—5 as shown in FIG. 5.

DETAILED DESCRIPTION OF THE PREFERRED EMBODIMENT

Figure 1:
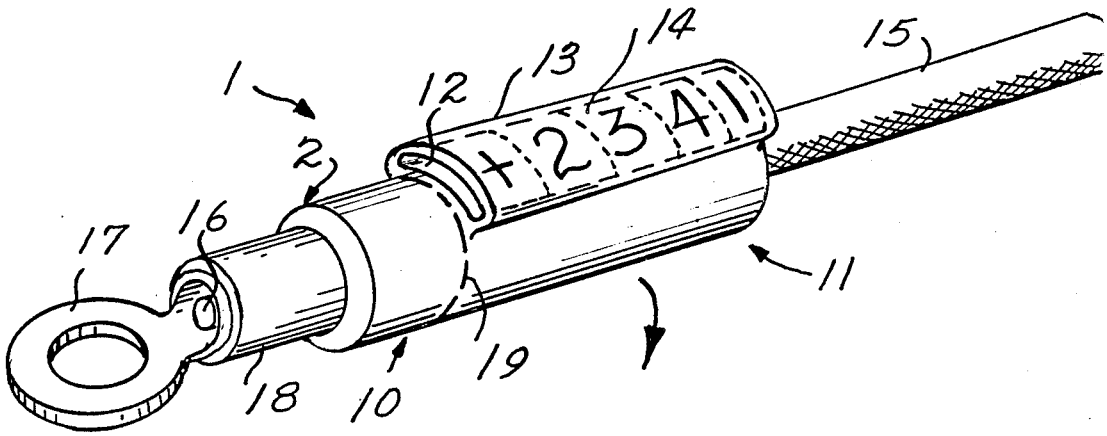
FIG. 1 shows a perspective view of the wire identification device according to the present invention before being attached to the wire.

Reference is now made to the figures in which like parts are identified with like reference numerals.

FIG. 1 shows wire identification device 1 of the present invention placed over stripped end 16 of wire 15. The device 1 has left portion 10 and right portion 11. Left portion 10 is integrally connected to electrically-conductive ring terminal 17. Right portion 11 has an identifying means, a cylindrical, hollow portion 13, integrally connected to it. Portion 13 defines alveolus channel 12 adapted for containing marked members 14. The marked members can be marked with alphanumeric symbols, color codes or any other suitable kind of indicia. These marked members 14 can be flexible marked rings of resilient material, or any other suitable marked piece adapted to be inserted into channel 12. Portion 13 is at least partially transparent so that members 14 can be easily seen and visibly displayed.

Wire marking device 1 also has a severable region 19, which may be a perforation or the like suitable for allowing left portion 10 to be severed from right portion 11. Region 19 may be any suitable weakening in the device to render the portions 10,11 frangible or severable from one another. Region 19 may be incorporated into the device 1 during molding or formation, or it may be added latter such as by mechanical perforation or scoring, etc.

Left portion 10 has a region 18 which is crimped along with a portion of ring terminal 17 to establish an electrical connection between terminal 17 and the stripped end 16 of wire 15.

Figure 2:
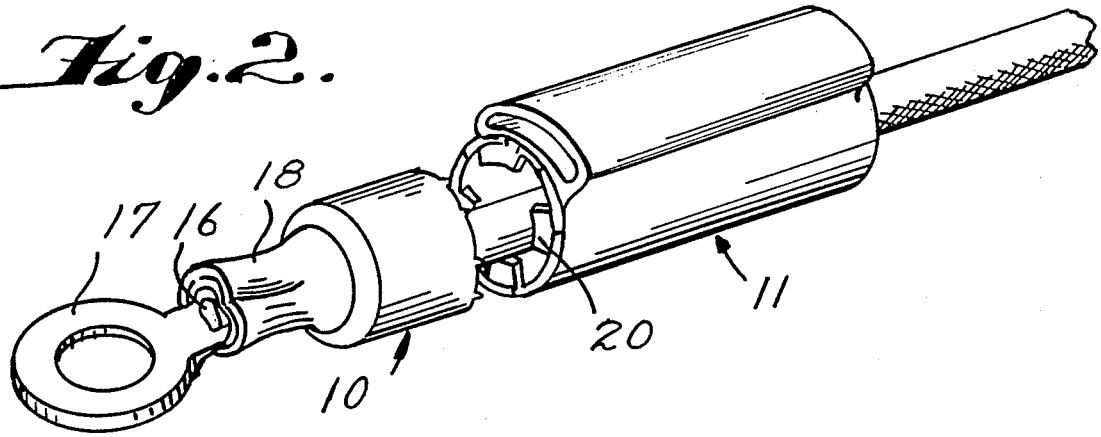
FIG. 2 shows a perspective view of the device of FIG. 1 in which the left portion has been crimped to the wire and the right portion has been severed from the left portion.

FIG. 2 shows region 18 and terminal 17 crimped to stripped end 16. FIG. 2 also shows portions 10,11 severed at region 19. Engaging means, shown here as lugs 20 are formed on the inside of right portion 11 for frictionally engaging left portion 10. The engaging means can be teeth, ridges or any other suitable structure for engaging left portion 10. As is shown in the figures, left portion 10 comprises a region 18 which is adapted to be crimped to wire end 16 and a region 2 of greater diameter. When right portion 11 is slid transversely over left portion 10, lugs 20 are deformed inward until they pass beyond region 2 of greater diameter.

Figure 3:
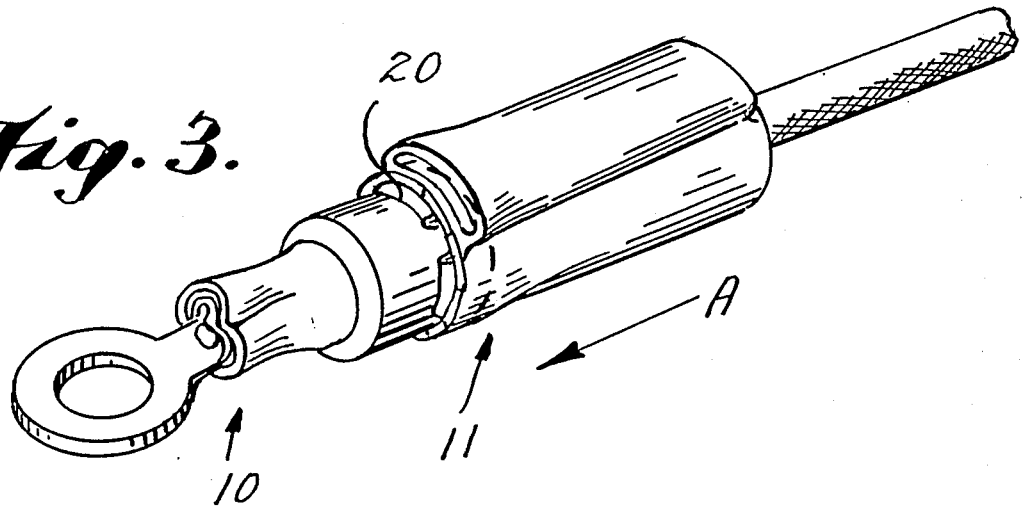
FIG. 3 shows the right portion being slid over the left portion.

FIG. 3 shows right portion 11 being slid transversely over left portion 10, along the arrow A shown in FIG. 3.

FIG. 4 shows right portion 11 slid over left portion 10 past the region 2 of greater diameter. Lugs 20 hold right portion 11 and hollow portion 13, which serves as an identifying means, in place on the wire. The preferred embodiment has the further advantage that right portion 11 may be rotated about the long axis of the wire, allowing portion 13, the identifying means, to be positioned in any desired position around the circumference of wire 16.

FIG. 5 shows the device of FIG. 4 in cross section. The hollow portion 13 and the alveolus channel 12 formed thereby are easily seen. Marked members 14 may be placed in alveolus channel 12 at any time before or after the device is put in place and crimped to wire 16. The crimped region 18 is seen within the outer diameter of right portion 11. Part of terminal 17 is seen establishing close, electrically conductive contact with wire end 16.

The inner diameter of portion 11 is preferably greater than the inner diameter of left portion 10 so as to facilitate the sliding of the one portion 11 over the other portion 10. Of course, separate engaging means may be dispensed with altogether if the diameter of the two portions 10, 11 are chosen such as to provide a tight, frictional fit.

FIG. 6 is a cross section along the long axis 5—5 shown in FIG. 4. FIG. 6 clearly illustrates the alveolus channel 12 formed by hollow portion 13 in which the marking members 14 are placed. FIG. 6 also shows lugs 20, which serve as engaging means, disposed on the inner circumference of right portion 11. The lugs are deformed inwardly as shown by the arrows in FIG. 6 when right portion 11 is slid over left portion 10.

Although a specific, preferred embodiment has been illustrated and described, one skilled in the art of the present will readily appreciate that departures can be made within the scope of the present invention which is determined solely by the appended claims.

What is claimed is:

1. An identification device for an electrical wire, comprising:
   - a cylindrical left portion adapted to be mounted on a wire to be identified;
   - a cylindrical right portion severably attached to said left portion and adapted to be severed and slid transversely over the left portion to frictionally engage the left portion, said right portion comprising engaging means for frictionally engaging said left portion when the right portion is slid over the left portion;
   - an identifying portion connected to the right portion, and for visibly displaying identification means.

2. An identification device according to claim 1, wherein said engaging means comprise lugs.

3. An identification device according to claim 1, wherein said engaging means comprise one or more ridges.

4. An identification device according to claim 1, wherein said left portion comprises an inner diameter, and said right portion comprises an inner diameter greater than the inner diameter of the left portion.

5. An identification device according to claim 1, wherein said identifying portion comprises an at least partially transparent alveolus channel for containing and visibly displaying said identification means.

6. An identification device according to claim 5, wherein said identification means comprises at least one discrete, marked member.

7. An identification device according to claim 6, wherein said marked member comprises a flexible ring adapted for insertion into said alveolus channel.

8. An identification device for an electrical wire, comprising:
   - a cylindrical left portion adapted to be mounted on a wire to be identified;
   - a cylindrical right portion severably attached to said left portion and adapted to be severed and slid transversely over the left portion to frictionally engage the left portion;
   - an identifying portion connected to the right portion, and for visibly displaying identification means; and
   - wherein said left portion further comprises an electrically conductive terminus, and wherein said terminus is adapted to be crimped to said wire to be identified.

9. An identification device according to claim 8, wherein said terminus is a pin terminus.

10. An identification device according to claim 8, wherein said terminus is a spade terminus.

11. An identification device according to claim 8, wherein said terminus is a ring terminus.

12. A method for marking an electrical wire comprising the steps of:

(a) placing a hollow, cylindrical marking device over a stripped end of the electrical wire, wherein the marking device comprises a left portion having a conductive wire terminal connected thereto, and a right portion, severable from the left portion, and having identifying means thereon;

(b) crimping the terminal and the left portion to the stripped end of the wire in order to establish electrical contact between the wire and the terminal;

(c) severing the right portion from the left portion and sliding the right portion transversely over the left portion in order to establish friction engagement of the left and right portions.

* * * * *